US005391408A

United States Patent [19]

Piera

[11] Patent Number: 5,391,408

[45] Date of Patent: Feb. 21, 1995

[54] METHOD FOR FIRING ENAMEL ON A METAL ARTICLE

[75] Inventor: Henri Piera, Rumilly, France

[73] Assignee: Seb S.A., Selongey, France

[21] Appl. No.: 966,184

[22] PCT Filed: Jun. 5, 1992

[86] PCT No.: PCT/FR92/00507

§ 371 Date: Jan. 29, 1993

§ 102(e) Date: Jan. 29, 1993

[87] PCT Pub. No.: WO92/21791

PCT Pub. Date: Dec. 10, 1992

[30] Foreign Application Priority Data

Jun. 5, 1991 [FR] France ..... 91 06789

[51] Int. Cl.[6] ..... B05D 5/00

[52] U.S. Cl. ..... 427/542; 427/197; 427/201; 427/287; 427/376.4; 427/379; 427/557; 427/559

[58] Field of Search ..... 427/557, 197, 201, 287, 427/376.4, 379, 559, 542

[56] References Cited

FOREIGN PATENT DOCUMENTS 3206333 9/1983 Germany .
63-282279 11/1988 Japan .

*Primary Examiner*—Bernard Pianalto
*Attorney, Agent, or Firm*—Young & Thompson

[57] ABSTRACT

The method for firing enamel on a metal article (2), subjected to a prior step for depositing, onto part of its surface, an enamel frit slip, followed by a step for obtaining a bisque on said component, comprises a step for exposing the article to infrared radiation of a maximum emission wavelength in a firing chamber (1).

4 Claims, 1 Drawing Sheet

METHOD FOR FIRING ENAMEL ON A METAL ARTICLE

The present invention relates to a method for firing enamel on a metal article, especially an aluminum article. It also relates to a device for its implementation.

Current methods for firing enamel on aluminum, derivatives of the methods for firing enamel on sheet metal and previously on ceramic, employ a convective-environment firing. Electric- or gas-heating elements heat, to a set temperature, the ambient air of a furnace into which an article to be enamelled placed on a support is placed. This air is next conveyed, rendered uniform and then projected onto the article by turbines. The hot air yields part of its thermal energy to the article, part of the surface of which has been covered beforehand with an enamel frit slip which, after drying, constitutes a bisque according to a technique well known in the field of enamel firing. The hot air is then recovered under the support and is heated once again by the heating elements placed in the walls of the furnace.

In these methods, the entire article to be enamelled is heated since this article and the enamel layer reach an equilibrium temperature equal to the temperature of the ambient air in the part of the furnace where the article is located. Consequently, the power of the furnace and its response depend on the mass and surface of the article.

Furthermore, the construction of a furnace employing a convection technique is tricky and expensive on account of the difficulty of conveying hot air at temperatures in the vicinity of 560° C., which correspond to the usual temperatures for firing the enamel on aluminum articles.

Moreover, the heating of such a furnace is lengthy,—1 to 2 hours in practice—, and therefore expensive in terms of energy. In addition, when the article has reached the set temperature, it is necessary to provide a temperature hold of at least 5 minutes in order for the enamel to reach its optimum properties.

In addition, the uniform heating of the article to be enamelled causes the expansion of the metal to take place in conjunction with the temperature rise of the enamel, which has the result of generating, on dished or pleated surfaces, breaks in the enamel bisque which does not have the same expansion coefficient as the metal.

The object of the present invention is to remedy these drawbacks by providing a method for firing enamel on a metal article, especially an aluminum article, subjected to a prior step for depositing an enamel frit slip onto part of the surface of the article, followed by a drying step leading to an enamel bisque being obtained on said article.

According to the invention, this firing method is distinguished in that it comprises, after the drying step, a step for exposing the article to infrared radiation of a predetermined maximum emission wavelength such that this radiation heats the enamel bisque in order to obtain the firing of the latter, without significantly heating the metal article.

The method according to the invention enables surprising results to be obtained in terms of operating flexibility, manufacturing simplicity, cost and quality of the enamel obtained.

Thus, a furnace implementing the method according to the invention is operational in a few seconds instead of one to two hours in the case of the prior methods, which results in rapid and cost-effective start-ups. Because of this, in the event of a momentary stop in production, the furnace may be stopped if it is empty.

With the method according to the invention, the ambient air has a temperature less than the vitrification temperature which is equal to 560° C. in the case of the firing of enamel on an aluminum article and is very much less than that of the infrared emitter (1000° to 2000° C.). In addition, this air only contributes to a slight degree to the heat exchange between the infrared emitter and the article to be enamelled which is carried out almost integrally by radiation, the air being practically stationary in the firing chamber. The construction of a furnace implementing the method according to the invention is therefore simpler and less expensive than that of prior furnaces.

Moreover, from the start of firing, there is a significant temperature gradient between the enamel and the article as the latter is heated solely by conduction through the enamel. Thus, the metal article heats up slowly, the more so as the surface of the metal article reflects heat. This gradient becomes blurred during the firing temperature-hold. The existence of this significant gradient has the result of reducing the bimetallic-strip effect constituted by the juxtaposition of two materials having different expansion coefficients and thus minimizing, or even eliminating, the cracks encountered in prior methods.

Furthermore, with an infrared-radiation heating, the weight of the article as well as its thickness are no longer, for an equivalent surface, determining factors regarding the rate of temperature rise for a given heating power. On the other hand, the surface to be heated and the shape of the latter affect the heating rate/heating power pair. Thus, with the method according to the invention, for an equivalent surface, the temperature rise of the enamel is practically doubled compared to that obtained with the prior methods.

Finally, the method according to the invention enables mechanical and physico-chemical enamel characteristics to be obtained which are equivalent, or even superior, to those obtained with conventional convective firing methods, but with a firing temperature-hold reduced to 2 minutes instead of 5 minutes necessary previously.

According to another aspect of the invention, the device for firing enamel on a metal article, especially an aluminum article, covered beforehand, at least on part of its surface, with an enamel bisque obtained from an enamel frit slip, said article being placed on a firing support disposed in a chamber, this device being distinguished in that it comprises means for emitting infrared radiation of a predetermined maximum emission wavelength, said infrared emission means being placed at a predetermined distance from the article to be enamelled and so that the part of the article covered by the enamel bisque is exposed to said infrared radiation.

BRIEF DESCRIPTION OF THE DRAWINGS

Other particular features and advantages of the invention will become clearer in the description given hereinbelow, by way of non-limiting example, of embodiments, with reference to the attached drawings in which:

FIG. 1 represents diagrammatically a firing chamber 1 into which is placed an article 2, for example an aluminum disc to be enamelled. This disc 2 is itself placed on a support 3.

Figure 1:
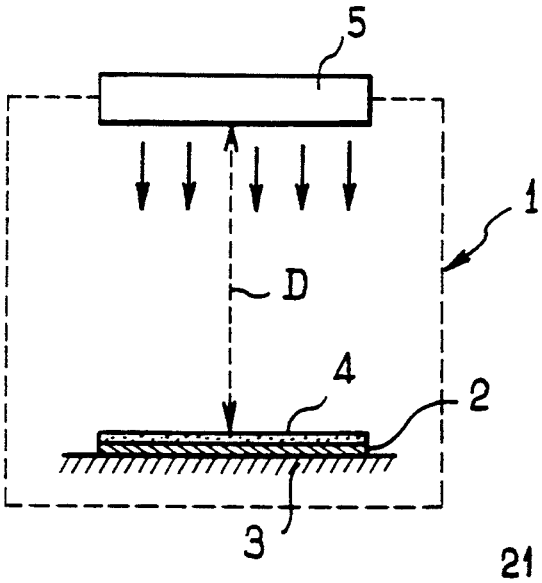
FIG. 1 is a diagram illustrating the method according to the invention.

The disc 2 is covered by a layer 4 of predried enamel frit slip. This layer 4 is therefore in the form of a substantially dry and porous bisque.

The layer 4 is exposed to the infrared radiation emitted by an infrared heating element 5 placed at a distance D from this layer 4.

The composition of the enamel bisque 4 is such that it vitrifies into an enamel layer at a certain temperature which is of the order of 560° C., when an enamel composition for aluminum is involved.

In accordance with the invention, the wavelength of the infrared radiation emitted by the element 5 and the distance D are such that the enamel bisque 4 heats up rapidly to the above vitrification temperature, the metal article 2 acting as a radiator.

This results especially in the following advantages:

energy saving, especially because the energy employed is practically reduced to that necessary for heating the enamel layer and to radiator-effect losses, improvement in the quality of the enamel, given the absence of cracks caused in a conventional furnace by a rapid heating of the metal supporting the metal disc, time saving.

An embodiment of the device according to the invention will now be described with reference to FIGS. 2 and 3.

Figure 2:
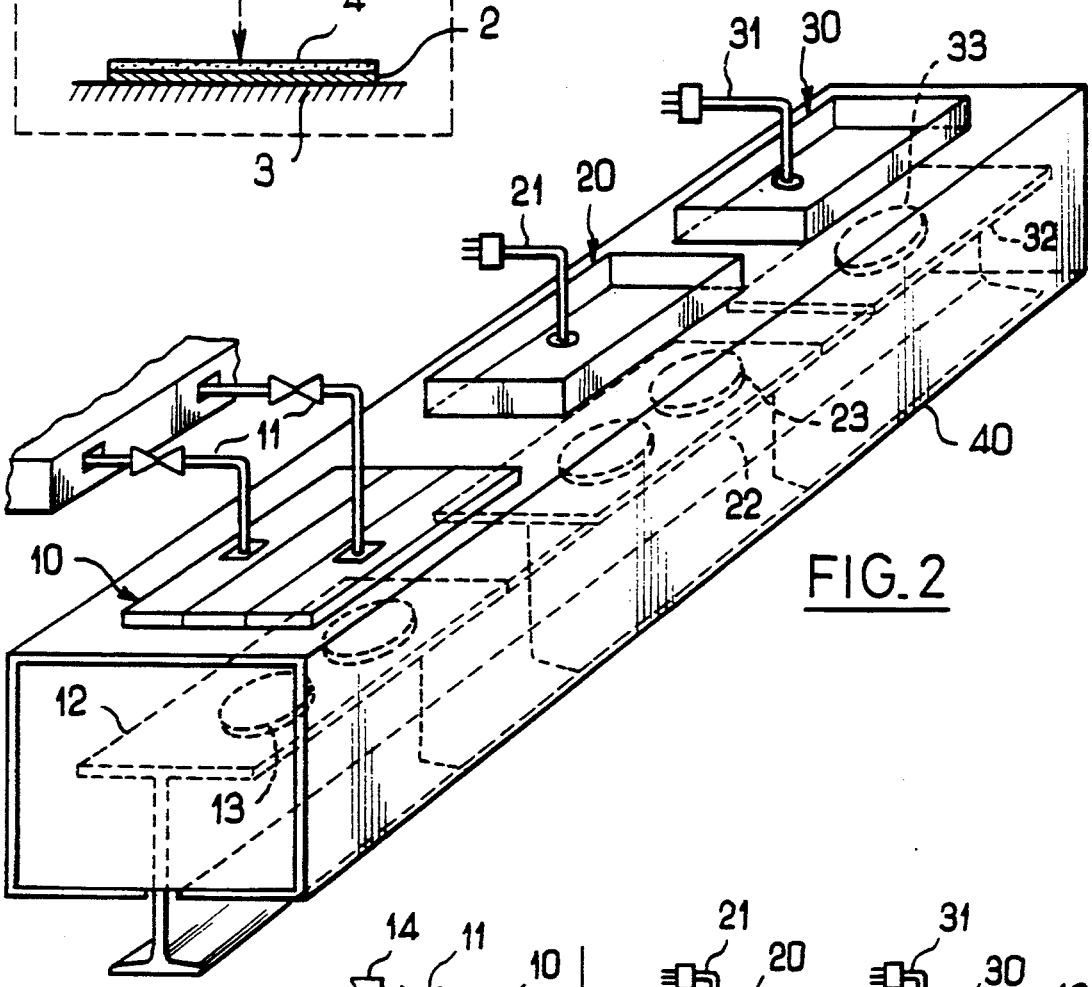
FIG. 2 shows a diagrammatic view of an experimental furnace installation implementing the method according to the invention.
Figure 3:
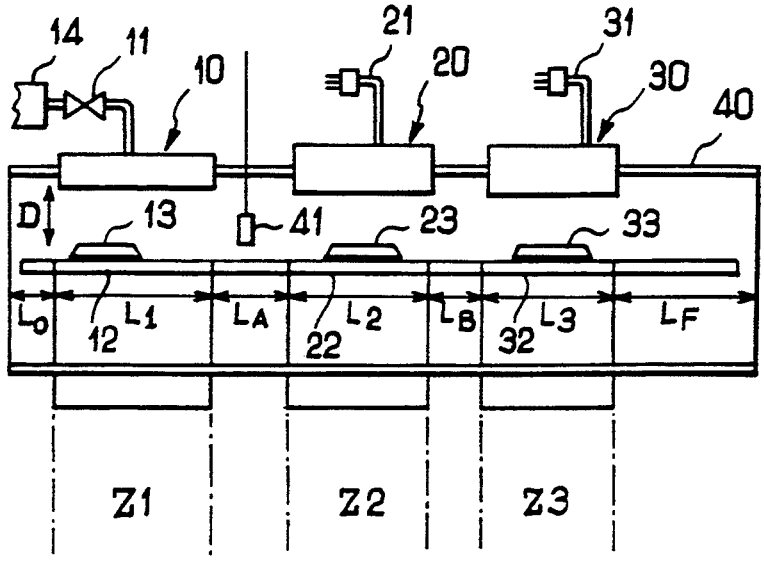
FIG. 3 is a sectional view of this installation.

The experimental furnace, illustrated diagrammatically by FIG. 2, constitutes a firing device according to the invention which comprises a firing chamber 40 made from insulating material of a thickness of 20 mm, which chamber is divided into 3 zones Z1, Z2 and Z3 (see FIG. 3), the first zone Z1 corresponding to the employment of a gas infrared emitter 10 whereas the other two zones Z2 and Z3 correspond to the employment of electrical emitters 20 and 30. Corresponding to each of the infrared emitters 10, 20 and 30 respectively is a portion of the firing support 12, 22 and 32 on which portion one or more articles 13, 23 and 33 to be enamelled are placed. The gas infrared emitter 10 is inserted into the firing chamber 40 and is connected via conventional pipework devices 11 to a gas supply device 14. The combustion of the gas in the emitter 10 is accompanied by an emission of infrared radiation to which the upper surface of the article 13 is exposed, which article is coated beforehand with a slip of predetermined constitution and a dried bisque obtained afterwards according to conventional techniques in this field.

The supports 12, 22, 32 are mounted so as to move inside the chamber.

The articles 13, 23, 33 may be, for example, cooking vessels.

The characteristic dimensions of the experimental furnace are as follows:

distance $L_0$ between the gas emitter 10 and a first end of the chamber: 160 mm, length $L_1$ of the gas emitter 10: 650 mm, distance $L_A$, between the zones 1 and 2: 200 mm, length $L_2$ of the electrical emitter 20: 610 mm distance $L_B$, between the zones 2 and 3: 100 mm, length of the electrical emitter 30: 600 mm, distance $L_F$, between the electrical emitter 30 and the other end of the chamber: 660 mm, total length of the experimental furnace 1: 2980 mm.

In the case of this experimental furnace, the optimum distance D separating the infrared emitters 10, 20 and 30 from the components 13, 23 and 33 to be enamelled is substantially equal to 160 mm. As a general rule, this optimum distance D depends on the emission power, on the shape and surface of the components and on the geometrical characteristics of the firing chamber.

The radiation power per unit surface of the gas emitter 10 is approximately 130 kW/m$^2$. Its temperature is approximately 1000° C. and its emission spectrum extends into the middle infrared range of approximately 1 μm to 8 μm, the maximum emission wavelength being substantially equal to 2 μm. The power emitted by the gas emitter 10 can be modulated from 50 to 100%.

The electrical infrared emitters 20, 30 are constituted by radiant elements supplied with electricity via connection means 21, 31. The two electrical emitters 20 and 30 also emit in the middle infrared range and its temperature is approximately 1200° C., the emission power per unit surface of this emitter being approximately 60 kW/m$^2$.

With these three emitters 10, 20, 30 emitting in the middle infrared range, the temperature of the ambient air, measured for example with an optical pyrometer 41 placed inside the chamber 40, is between 100° and 450° C., therefore very much less than the temperature of the emitters.

An alternative embodiment could be constituted by two emitters 20 and 30 emitting in the near-infrared range.

The electrical emitters are near-infrared tube emitters having an emitter temperature of approximately 2200° C., an emission power per unit surface between 100 and 300 kW/m$^2$ and an emission spectrum extending between 0.6 μm and 4.8 μm, the maximum emission wavelength being substantially equal to 1.2 μm. This type of emitter has a very high emission power and an emitter temperature very much greater than that of the other emitters tested. However, it is very sensitive to variations in tint of the slip and cannot withstand an ambient air temperature greater than 100° C.

The two electrical emitters 20, 30 have, in common, the capacity to be modulated in terms of power by from 0 to 100% of their installed power.

The exposure times of the components to the infrared radiation emitted by the emitters 10, 20 and 30 vary from 3 minutes 30 seconds to 7 minutes, depending on the shape and the surface of the components to be enamelled. At the end of exposure, the aluminum of the article reaches, by conduction, the equilibrium temperature corresponding to the vitrification temperature of the enamel, namely 560° C.

The method according to the invention can easily be applied to a manufacturing line, a moving support belt for components then being provided for conveying the components to be enamelled into the firing chamber and successively exposing them to the radiation emitted by the infrared emitter for a predetermined exposure time depending on the shape and surface of the article.

Another significant characteristic of the method according to the invention resides in the possibility of measuring the direct temperature of the enamelled component, for example by means of an infrared pyrometer, this temperature enabling the heating power of the infrared emitters to be controlled.

In fact, in the conventional method, the ambient temperature is measured for controlling the heating power, given that the components to be enamelled are at the same temperature as the ambient temperature.

Of course, the invention is not limited solely to the examples described and numerous arrangements may be made to these examples without departing from the scope of the invention.

Thus, it is possible to envisage other types of infrared-emitter configurations. In addition, the geometry of the firing chamber may be defined according to current or future technological construction criteria. It is also possible to provide other devices for conveying the components to be enamelled into the firing chamber. Moreover, the firing method according to the invention obviously allows the prior implementation of a silk-screening operation on the bisque before firing.

I claim:

1. A method for firing enamel on a metal article subjected to a prior step for depositing, onto at least part of its surface, an enamel frit slip, followed by a drying step, which comprises, after the drying step, a step for exposing only the enamel on the article to infrared radiation of a wavelength such that it directly heats only the enamel without directly heating the metal article.

2. The method as claimed in claim 1, wherein the infrared radiation comes from infrared emission means placed in a firing chamber at a distance from the article to be enamelled.

3. The method as claimed in claim 2, wherein it furthermore comprises a step for modulating the emission power of the infrared emission means as a function of the article to be enamelled.

4. The method as claimed in claim 2, wherein the article is carried by a support belt moving with respect to the infrared emission means.

* * * * *